US005735426A

United States Patent [19]

Babcock et al.

[11] Patent Number: 5,735,426

[45] Date of Patent: Apr. 7, 1998

[54] FITMENT-CLOSURE ASSEMBLY FOR GABLE-TOPPED CARTON

[75] Inventors: David E. Babcock, Lafayette; Hugh C. Urmston, Carmel, both of Ind.

[73] Assignee: Alcoa Closure Systems International Inc., Crawfordsville, Ind.

[21] Appl. No.: 768,138

[22] Filed: Dec. 17, 1996

[51] Int. Cl.[6] ..... B65D 51/22

[52] U.S. Cl. ..... 220/258; 220/270; 220/276; 215/256; 215/354; 229/125.15; 222/541

[58] Field of Search ..... 215/253, 256, 215/354; 220/258, 270, 276; 229/125.15; 222/541

[56] References Cited

U.S. PATENT DOCUMENTS

| | | | |
|---|---|---|---|
| 4,813,578 | 3/1989 | Gordon et al. . | |
| 5,020,683 | 6/1991 | Strassheimer | 215/354 |
| 5,110,040 | 5/1992 | Kalberer et al. . | |
| 5,133,486 | 7/1992 | Moore et al. | 220/258 X |
| 5,152,438 | 10/1992 | Gordon et al. . | |
| 5,176,300 | 1/1993 | Kishikawa et al. . | |
| 5,199,635 | 4/1993 | Abrams et al. . | |
| 5,249,695 | 10/1993 | Luch et al. . | |
| 5,348,182 | 9/1994 | Luch . | |
| 5,379,910 | 1/1995 | Montgomery . | |
| 5,456,376 | 10/1995 | Luch et al. | 215/354 X |
| 5,549,213 | 8/1996 | Robbins, III et al. | 215/354 X |
| 5,593,055 | 1/1997 | Repp et al. | 215/256 |

*Primary Examiner*—Stephen Cronin
*Attorney, Agent, or Firm*—Dressler, Rockey, Milnamow & Katz, Ltd.

[57] ABSTRACT

A fitment and closure assembly useful with a gable-topped carton having a gable-forming panel with a pouring hole, through which contents are pourable from the carton, is molded from low density polyethylene. A fitment having a tubular spout formed with an external thread and an annular flange extending outwardly from the tubular spout, below the external thread, is attachable to the gable-forming panel so that the annular flange is attached to the gable-forming panel, around the pouring hole, and so that the tubular spout extends upwardly from the pouring hole. A closure having an upper wall, a tubular skirt with an internal thread and an upper shoulder, and a plug seal forming an annular recess between the plug seal and the upper shoulder is threadable onto the fitment so that the external and internal threads are interengaged and so that the upper end of the tubular spout enters the annular recess with an interference fit. A tear-away web disposed within the tubular spout is attached to the intermediate shoulder by a tearable membrane extending around the intermediate shoulder, below the upper portion of the tubular spout, so that the internal cross section of the tubular spout is not reduced significantly above the intermediate shoulder by any residue of the tearable membrane. A pull ring is attached unitarily to the tear-away web, near the tearable membrane, for initiating a tear in the tearable membrane. Optionally, the tubular skirt has a tear-away band, below the internal thread.

14 Claims, 1 Drawing Sheet

FITMENT-CLOSURE ASSEMBLY FOR GABLE-TOPPED CARTON

TECHNICAL FIELD OF THE INVENTION

This invention pertains to an assembly of a fitment and a closure, each molded from a polymeric material, such as low density polyethylene. The assembly is useful with a gable-topped carton having a gable-forming panel with a pouring hole, through which contents are pourable from the carton, and embodies improvements over previously known, similarly useful assemblies.

BACKGROUND OF THE INVENTION

Gable-topped cartons made from plasticized paperboard are used widely to package milk, fruit juices, and other liquid and dry contents. Commonly, a gable-forming panel of a gable-topped carton is provided with a pouring hole, through which contents are pourable from the carton.

When a pouring hole is provided in a gable-forming panel, as mentioned above, it is known to attach a fitment to the gable-forming panel so that a tubular spout of the fitment extends upwardly from the pouring hole and so that an annular flange of the fitment engages the gable-forming panel, around the pouring hole. Moreover, it is known to thread a closure onto the fitment so that an external thread of the fitment and an internal thread of the closure are interengaged.

Such fitment and closure assemblies are exemplified in prior patents including Gordon et al. U.S. Pat. No. 4,813,578 Gordon et al. U.S. Pat. No. 5,152,438, Kishiwaka et al. U.S. Pat. No. 5,176,300, Luch U.S. Pat. No. 5,348,182, and Montgomery U.S. Pat. No. 5,379,910. As exemplified in many of these patents, it is known to mold the fitments and the closures from polymeric materials, such as low density polyethylene. As exemplified in Kishiwaka et al. U.S. Pat. No. 5,176,300, it is known to provide the fitment with a tear-away web, to which a pull ring is attached unitarily.

Especially if low density, thin-walled, polymeric materials are used for the fitments and the closures, it is difficult to control dimensions and tolerances and to provide seals, as needed, and to avoid collapse of the tubular spout when the fitments and the closures are assembled initially, when the closures are removed by users, and when the fitments and the closures are reassembled by users.

SUMMARY OF THE INVENTION

This invention provides a fitment and closure assembly, which is useful with a gable-topped carton having a gable-forming panel with a pouring hole, as discussed above. The fitment and closure assembly comprises a fitment and a closure, each molded from a polymeric material, such as low density polyethylene. As discussed below, the fitment and closure assembly embodies improvements over previously known, similarly useful assemblies.

The fitment has a tubular spout and an annular flange, which is unitary with the tubular spout. The tubular spout is formed with an external thread and terminates at an unthreaded, upper end, which extends above the external thread. The annular flange extends outwardly from the tubular spout, below the external thread.

The fitment is attachable to the gable-forming panel so that the annular flange is attached to the gable-forming panel, around the pouring hole, and so that the tubular spout extends upwardly from the pouring hole. The annular flange may be thus attached to an inner or outer surface of the gable-forming panel and may be thus attached adhesively or via welding or solvent bonding.

The closure has an upper wall, a tubular skirt, which is unitary with the upper wall, and a plug seal, which is unitary therewith. The tubular skirt depends from the upper wall and has an internal thread and an upper shoulder above the internal thread. The plug seal is tubular and depends from the upper wall so as to form an annular recess between the plug seal and the upper shoulder. The plug seal extends below the upper shoulder.

The closure is threadable onto the fitment so that the external and internal threads are interengaged, so that the plug seal enters the tubular spout before the upper end of the tubular spout enters the annular recess, and so that the upper end of the tubular spout enters the annular recess so as to provide a seal between the upper shoulder and the upper end of the tubular spout. Preferably, the closure is threadable onto the fitment so that the upper end of the tubular spout enters the annular recess with an interference fit so as to provide a seal between the plug seal and the upper end of the tubular spout and the seal between the upper shoulder and the upper end of the tubular spout.

Preferably, the tubular spout has an upper portion having the upper end and having the external thread and a lower portion meeting the upper portion at an intermediate shoulder, and the tubular spout is comparatively smaller in internal cross section above the intermediate shoulder and being comparatively larger in internal cross section below the shoulder. Preferably, the fitment has a tear-away web disposed within the tubular spout and attached to the intermediate shoulder by a tearable membrane extending around the intermediate shoulder, below the upper portion of the tubular spout, so that the internal cross section of the tubular spout is not reduced significantly above the intermediate shoulder by any residue of the tearable membrane when the tear-away web is torn away along the tearable membrane. Preferably, the fitment has a pull ring attached unitarily to the tear-away web, near the tearable membrane.

In one contemplated embodiment, in which the tubular spout has a thickness in a range from approximately 0.027 inch to approximately 0.033 inch, except at the external thread, in which the tear-away web has a thickness in a range from approximately 0.032 inch to approximately 0.038 inch, and in which the tearable membrane has a thickness in a range from approximately 0.005 inch to approximately 0.007 inch, the fitment comprises means including the pull ring for initiating a tear in the tearable membrane when a pull force in a range from approximately five pounds to approximately eight pounds is exerted upwardly on the pull ring while the tubular spout and the annular flange are held.

These and other objects, features, and advantages of this invention are evident from the following description of a preferred embodiment of this invention, with reference to the accompanying drawings.

BRIEF DESCRIPTION OF THE DRAWINGS

FIG. 3 indicates with a dashed line where the closure may be optionally provided with a tear-away band.

DETAILED DESCRIPTION OF PREFERRED EMBODIMENT

Figure 1:
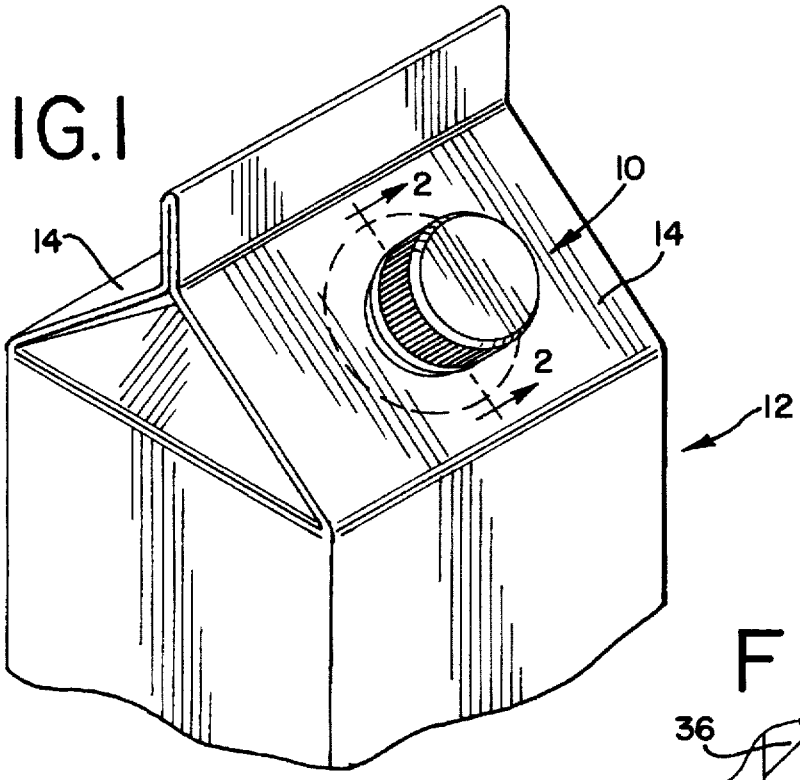
FIG. 1 is a fragmentary, perspective view of an upper portion of a gable-topped carton, which has been equipped with a fitment and closure assembly embodying this invention.

As shown in the drawings, a fitment and closure assembly 10 constituting a preferred embodiment of this invention is useful with a gable-topped carton 12 made from plasticized paperboard and having two gable-forming panels 14, one of which is formed with a pouring hole 16 (see FIG. 3) through which contents are pourable from the carton 12. Around the pouring hole 16, the gable-forming panel 14 formed with the pouring hole 16 has an annular, marginal portion 18. Other details of the carton 12 are outside the scope of this invention.

The assembly 10 comprises a fitment 30 and a closure 60. The fitment 30 and the closure 60 are molded from a polymeric material, such as low density polyethylene, which is preferred. Preferably, the fitment 30 is molded in a manner disclosed in a copending, commonly owned application, U.S. patent application Ser. No. 08/643,929, which was filed on May 7, 1996, and the disclosure of which is incorporated herein by reference.

As molded, the fitment 30 has a tubular spout 32, which defines an axis of the fitment 30. Further, the fitment 30 has an annular flange 34, which is unitary with the tubular spout 32 and coaxial therewith. The tubular spout 32 has an upper portion 36 and a lower portion 38 meeting the upper portion 36 at an intermediate shoulder 40. The tubular spout 32 is comparatively smaller in internal diameter, and in internal cross section, above the intermediate shoulder 40 and comparatively larger in internal diameter, and in internal cross section, below the intermediate shoulder 40. The upper portion 36 of the tubular spout 32 is formed with an external thread 42 and terminates at an unthreaded, upper end 44 extending above the external thread 42. The annular flange 34 extends outwardly from the lower portion 38 of the tubular spout 32, below the external thread 42. The fitment 30 is attached to the gable-forming panel 14 formed with the pouring hole 16 so that the annular flange 34 is attached thereto, around the pouring hole 16, and so that the tubular spout 32 extends upwardly from the pouring hole 16.

Preferably, as shown, the annular flange 34 is attached adhesively or via welding or solvent bonding to an inner surface 20 of the gable-forming panel 14 formed with the pouring hole 16 so as to provide a seal between the annular flange 34 and the inner surface 18, around the pouring hole 16. As shown, the annular flange 34 is formed with an upper, annular recess 46 to receive the annular, marginal portion 18 around the pouring hole 16. Alternatively, the annular flange 34 is attached adhesively or via welding or solvent bonding to an outer surface 22 of the gable-forming panel 14 formed with the pouring hole 16 so as to provide a seal between the annular flange 34 and the inner surface 18, around the pouring hole 16. How the annular flange 34 is attached is outside the scope of this invention.

The fitment 30 has a tear-away web 50, which is disposed within the tubular spout 32 and which is attached to the intermediate shoulder 40 by a tearable membrane 52 extending around the intermediate shoulder 40, below the upper portion 36 of the tubular spout 32. Thus, when the tear-away web 50 is tom away along the tearable membrane 52, the internal cross section of the tubular spout 32 is not reduced significantly above the intermediate shoulder 40 by any residue of the tearable membrane 52. Further, a pull ring 54 is attached unitarily to the tear-away web 50, near the tearable membrane 52, for initiating a tear in the tearable membrane 52 when a pull force is exerted upwardly on the pull ring 54 while the tubular spout 32 and the annular flange 34 are held.

In one contemplated embodiment, which is molded from low density polyethylene, the tubular spout 32 has a thickness in a range from approximately 0.027 inch to approximately 0.033 inch, except at the external thread 42, the tear-away web has a thickness in a range from approximately 0.032 inch to approximately 0.038 inch, the tearable membrane 52 has a thickness in a range from approximately 0.005 inch to approximately 0.007 inch, and the pull ring initiates a mar in the tearable membrane 52 when a pull force in a range from approximately five pounds to approximately eight pounds is exerted upwardly on the pull ring 54 while the carton 12 is held so that the tubular spout 32 and the annular flange 34 are held.

As molded, the closure 60 has a circular, upper wall 62, which defines an axis of the closure 60. Further, the closure 60 has a tubular skirt 64, which is unitary with the upper wall 62 and coaxial therewith and which depends from the upper wall 62. Further, the closure 60 has a plug seal 66, which is tubular, unitary with the upper wall 62 and with the tubular skirt 64, and coaxial therewith, and which depends from the upper wall 62. The tubular skirt 64 is knurled externally and has an internal thread 68, which is complementary with the external thread 42. The tubular skirt 64 has an upper shoulder 70 above the internal thread 68. The plug seal 66 depends from the upper wall 62 so as to form an annular recess 72 between the plug seal 66 and the upper shoulder 70.

The closure 60 is threadable onto the fitment 30 so that the external thread 42 of the tubular spout 32 and the internal thread 68 of the tubular skirt 64 are interengaged and so that the upper end 44 of the tubular spout 32 enters the annular recess 72 with an interference fit so as to provide a primary seal at an annular interface between the plug seal 66 and the upper end 44 of the tubular spout 32 and a secondary seal at an annular interface between the upper shoulder 70 and the upper end 44 of the tubular spout 32.

When the closure 60 is threaded onto the fitment 30, the plug seal 66 enters the upper end 44 before the upper end 44 enters the annular recess 72, because the plug seal 66 extends below the upper shoulder 70. Thus, if the upper end 44 of the tubular skirt 64 has collapsed somewhat before the closure 60 is threaded onto the fitment 30, the plug seal 66 can restore the upper end 44 to a circular cross section so that the primary and secondary seals can be reliably provided.

Figure 3:
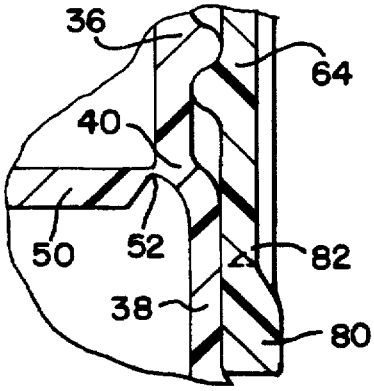
FIG. 3 is an enlarged detail of a region indicated by a dashed circle in FIG. 2.
Figure 2:
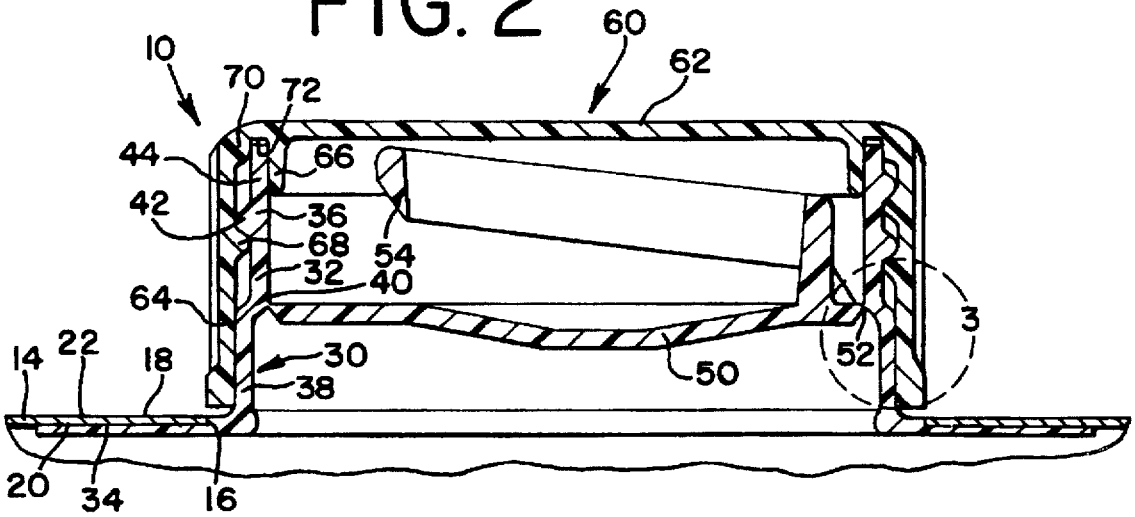
FIG. 2, on a larger scale compared to FIG. 1, is a sectional view taken along line 2—2 of FIG. 1, in a direction indicated by arrows.

As shown in FIG. 3, the tubular skirt 64 of the closure 60 may be optionally formed with a tear-away band 80 of a known type, below the internal thread 68. The tear-away band 80 is delineated from other portions of the tubular skirt 64 by a weakened line 82 of a known type, such as a perforated or scored line. The tear-away band 80 may have a pull tab (not shown) of a known type.

Various other modifications may be made in the preferred embodiment shown in the drawings and described above without departing from the scope and spirit of this invention.

What is claimed is:

1. A fitment and closure assembly useful with a gable-topped carton having a gable-forming panel with a pouring hole, through which contents are pourable from the carton, the fitment and closure assembly comprising (a) a fitment molded from a polymeric material and having a tubular spout and an annular flange unitary with the tubular spout, the tubular spout being formed with an external thread and terminating at an unthreaded, upper end extending above the external thread, the annular flange extending outwardly from the tubular spout, below the external thread, the fitment being attachable to the gable-forming panel so that the annular flange is attached to the gable-forming panel, around the pouring hole, and so that the tubular spout extends upwardly from the pouring hole, (b) a closure molded from a polymeric material and having an upper wall and a tubular skirt unitary with the upper wall, the tubular skirt depending from the upper wall and having an internal thread and an upper shoulder above the internal thread, the closure having a plug seal unitary with the closure wall, the plug seal being tubular and depending from the upper wall so as to form an annular recess between the plug seal and the upper shoulder, the plug seal extending below the upper shoulder, the closure being threadable onto the fitment so that the external and internal threads are interengaged, so that the plug seal enters the tubular spout before the upper end of the tubular spout enters the annular recess to provide a primary seal at an annular interface between the plug seal and the upper end of the tubular spout, and so that the upper end of the tubular spout enters the annular recess with an interference fit so as to provide a seal at another annular interface between the upper shoulder and an outwardly facing surface of the upper end of the tubular spout, said plug seal extending into said upper end of said tubular spout inwardly of said external thread, said tubular spout having a thickness no greater than approximately 0.033 inch, except at the external thread.

2. The fitment and closure assembly of claim 1 wherein the tubular skirt of the closure has a tear-away band, below the internal thread.

3. The fitment and closure assembly of claim 1 wherein the tubular spout has an upper portion having the upper end and having the external thread and a lower portion meeting the upper portion at an intermediate shoulder, the tubular spout being comparatively smaller in internal cross section above the intermediate shoulder and being comparatively larger in internal cross section below the intermediate shoulder.

4. The fitment and closure assembly of claim 3 wherein the fitment has a tear-away web disposed within the tubular spout and attached to the intermediate shoulder by a tearable membrane extending around the intermediate shoulder, below the upper portion of the tubular spout, so that the internal cross section of the tubular spout is not reduced significantly above the intermediate shoulder by any residue of the tearable membrane when the tear-away web is torn away along the tearable membrane.

5. The fitment and closure assembly of claim 4 wherein the fitment has a pull ring attached unitarily to the tear-away web, near the tearable membrane.

6. The fitment and closure assembly of claim 5 wherein the tubular spout has a thickness in a range from approximately 0.027 inch to approximately 0.033 inch, except at the external thread, wherein the tear-away web has a thickness in a range from approximately 0.032 inch to approximately 0.038 inch, wherein the tearable membrane has a thickness in a range from approximately 0.006 inch to approximately 0.007 inch, and wherein the fitment comprises means including the pull ring for initiating a tear in the tearable membrane when a pull force in a range from approximately five pounds to approximately eight pounds is exerted upwardly on the pull ring while the tubular spout and the annular flange are held.

7. The fitment and closure assembly of claim 1 wherein the tubular spout has an upper portion having the upper end and having the external thread and a lower portion meeting the upper portion at an intermediate shoulder, the tubular spout being comparatively smaller in internal cross section above the intermediate shoulder and being comparatively larger in internal cross section below the intermediate shoulder.

8. The fitment and closure assembly of claim 7 wherein the fitment has a tear-away web disposed within the tubular spout and attached to the intermediate shoulder by a tearable membrane extending around the intermediate shoulder, below the upper portion of the tubular spout, so that the internal cross section of the tubular spout is not reduced significantly above the intermediate shoulder by any residue of the tearable membrane when the tear-away web is torn away along the tearable membrane.

9. The fitment and closure assembly of claim 8 wherein the fitment has a pull ring attached unitarily to the tear-away web, near the tearable membrane.

10. The fitment and closure assembly of claim 9 wherein the tubular spout has a thickness at the intermediate shoulder in a range from approximately 0.027 inch to approximately 0.033 inch, except at the external thread, wherein the tear-away web has a thickness in a range from approximately 0.032 inch to approximately 0.038 inch, wherein the tearable membrane has a thickness in a range from approximately 0.006 inch to approximately 0.007 inch, and wherein the fitment comprises means including the pull ring for initiating a tear in the tearable membrane when a pull force in a range from approximately five pounds to approximately eight pounds is exerted upwardly on the pull ring while the tubular spout and the annular flange are held.

11. A fitment adapted to receive a closure and useful with a gable-topped carton having a gable-forming panel with a pouring hole, through which contents are pourable from the carton, the fitment being molded from a polymeric material and having a tubular spout .and an annular flange unitary with the tubular spout, the tubular spout being formed with an external thread and terminating at an unthreaded, upper end extending above the external thread, the annular flange extending outwardly from the tubular spout, below the external thread, the fitment being attachable to the gable-forming panel so that the annular flange is attached to the gable-forming panel, around the pouring hole, and so that the tubular spout extends upwardly from the pouring hole, wherein the tubular spout has an upper portion having the upper end and having the external thread and a lower portion meeting the upper portion at an intermediate shoulder, the tubular spout being comparatively smaller in internal cross section above the intermediate shoulder and being comparatively larger in internal cross section below the intermediate shoulder, and wherein the fitment has a tear-away web having a cross section substantially equal to the upper portion internal cross section, disposed within the tubular spout, and attached to the intermediate shoulder by a tearable membrane extending around the intermediate shoulder, below the upper portion of the tubular spout, so that the internal cross section of the tubular spout is not reduced significantly above the intermediate shoulder by any residue of the tearable membrane when the tear-away web is torn away along the tearable membrane.

12. The fitment of claim 11 wherein the fitment has a pull ring attached unitarily to the tear-away web, near the tearable membrane.

13. The fitment of claim 12 wherein the tubular spout has a thickness at the intermediate shoulder in a range from approximately 0.027 inch to approximately 0.033 inch, except at the external thread, wherein the tear-away web has a thickness in a range from approximately 0.032 inch to approximately 0.038 inch, wherein the tearable membrane has a thickness in a range from approximately 0.006 inch to approximately 0.007 inch, and wherein the fitment comprises means including the pull ring for initiating a mar in the tearable membrane when a pull force in a range from approximately five pounds to approximately eight pounds is exerted upwardly on the pull ring while the tubular spout and the annular flange are held.

14. The fitment of claim 11 wherein the tubular skirt of the closure has a tear-away band, below the internal thread.

* * * * *